US005595232A

United States Patent [19]

Benthin

[11] Patent Number: 5,595,232

[45] Date of Patent: Jan. 21, 1997

[54] DEVICE FOR MANUALLY OPERATING A BLIND, PREFERABLY A VERTICAL BLIND

[75] Inventor: Siegfried Benthin, Bremerhaven, Germany

[73] Assignee: Benthin Aktiengesellschaft, Bremerhaven, Germany

[21] Appl. No.: 450,195

[22] Filed: May 25, 1995

[30] Foreign Application Priority Data

May 28, 1994 [DE] Germany ..... 44 18 735.1

[51] Int. Cl.[6] ..... E06B 9/30

[52] U.S. Cl. ..... 160/178.1; 160/320; 160/900

[58] Field of Search ..... 160/178.2 R, 168.1 V, 160/168.1 R, 176.1 V, 176.1 R, 178.1 V, 178.1 R, 344, 319, 320, 321, 900

[56] References Cited

U.S. PATENT DOCUMENTS

| | | | |
|---|---|---|---|
| 3,050,803 | 8/1962 | Hulterstrum | 160/344 X |
| 3,123,182 | 3/1964 | Malone et al. | 160/178.1 V |
| 3,478,807 | 11/1969 | Hertzberg | 160/344 |
| 4,813,469 | 3/1989 | Scott . | |
| 5,125,447 | 6/1992 | Suggs | 160/344 |
| 5,167,268 | 12/1992 | Mao | 160/178.2 R |
| 5,465,775 | 11/1995 | Biba et al. | 160/168.1 R |
| 5,465,779 | 11/1995 | Rozon | 160/168.1 V |
| 5,472,035 | 12/1995 | Biba et al. | 160/168.1 R |
| 5,472,036 | 12/1995 | Judkins | 160/178.2 R |

FOREIGN PATENT DOCUMENTS

| | | | |
|---|---|---|---|
| 1136461 | 9/1962 | Germany | 160/178.2 |
| 1966483 | 3/1973 | Germany | 160/178.2 |

*Primary Examiner*—David M. Purol
*Attorney, Agent, or Firm*—McGlew and Tuttle

[57] ABSTRACT

A device for the manual operation of a blind, preferably a vertical blind, by way of a pull cord, which is pulled as a loop with a leading end and a return end by a slat carriage movable in a guide with a slat each arranged on them around their longitudinal axis. The device has a grip body that can be grasped, with a passage for the leading end and a passage for the return end of the pull cord. A clamping device is provided that can be switched from the outside for the leading end. A clamping device is also provided that can be switched from the outside for the return end (6b) of the pull cord (6).

20 Claims, 6 Drawing Sheets

HORIZONTAL BLIND SYSTEM

VERTICAL BLIND SYSTEM

HORIZONTAL BLIND SYSTEM

SWITCHING POSITION A

SWITCHING POSITION B

SWITCHING POSITION A

SWITCHING POSITION B

SWITCHING POSITION D

SWITCHING POSITION E

VARIANT 2 FOR PIVOTING THE SLATS

DEVICE FOR MANUALLY OPERATING A BLIND, PREFERABLY A VERTICAL BLIND

FIELD OF THE INVENTION

The present invention pertains to a device for operating a blind, preferably a vertical blind, by means of a pull cord, the cord being led in a manner of a loop with a leading end and a return end and including a grip body that can be grasped, the grip body having a passage for the leading end and a passage for the return end of the pull cord. The gripping body includes a clamping means for clamping the leading end portion of the cord, the clamping means being switchable from an outside of the gripping body and including a clamping means for engaging the return end portion of the pull cord, the return end clamping means being switchable from the outside of the gripping body.

BACKGROUND OF THE INVENTION

Such a device has been known from U.S. Pat. No. 4,813,469.

In vertical blinds, the guide for the traveling movement consists of a usually horizontally fastened support rail, so that the ends of the pull cord, which also extends horizontally in the support rail in the area to be covered by the blind, run over a deflecting means and hang down loosely, and the pull cord frequently also forms a loop in this part and is thus designed as an endless pull cord. The hanging-down loop of the pull cord is frequently disturbing and represents a hazard, especially for small children. The blind can be opened and closed manually by means of a device of the class described in the introduction, while the slat carriages are either pushed together at a storage place or they are pulled apart, spread over the area to be covered by the blind. Large blinds and special designs have motor drives, preferably electric motor drives, for the pull cord. Horizontal blinds, in which the slats are fastened directly to two or more pull cords, which are arranged in parallel to and at spaced locations from one another, are also designed correspondingly.

SUMMARY OF THE INVENTION

The primary object of the present invention is to avoid hazards especially for small children due to the pull cord and to improve the appearance of the hanging-down pull cord.

According to the invention, a device for the manual operation of a blind is provided, preferably vertical blinds but also horizontal blinds. A pull cord is provided which is disposed in the manner of a loop and includes a leading end portion and a return end portion. A section rail is provided accommodating the pull cord leading end portion and the return end portion. The sectional rail has channels extending in a longitudinal direction defining passages for the leading end portion and the return end portion of the pull cord. A grip body is provided which can be grasped. The grip body includes a passage for the leading end portion of the pull cord and a passage for the return end portion of the pull cord. The grip body includes leading end clamping means for clamping the leading end portion of the pull cord. The leading end clamping means can be switched from the outside of the grip body. The grip body also includes return end clamping means for clamping the return end portion of the pull cord. The return end clamping means can also be switched from the outside of the grip body. The grip body is guided movably on the stationarily arranged section rail.

The sectional rail has channels extending in its longitudinal direction, through which the two ends of the pull cord, namely, the leading end and the return end, are led. These channels of the sectional rails, which may be open on the longitudinal sides, thus accommodate the ends of the pull cords in them, so that no pull cord is visible on the outside, and this pull cord also no longer represents a hazard of strangling for small children. A preferred embodiment of the sectional rail has an H-shaped cross-sectional profile with convex lateral surfaces. A deflecting means for a pull cord guided as an endless pull cord may be provided at the lower end of the sectional rail. However, a pull cord of finite length is also possible, so that the leading end and the return end move up and down in the corresponding channel of the sectional rail during the operation of the blind.

Another special feature of the present invention is that the switching slide, which is guided in the grip body at right angles to the longitudinal axis of the pull cord in such a way that it can be pushed to and fro. The switching slide has wedge surfaces on its underside, and each of these wedge surfaces cooperates with a counterwedge surface on a switching rod each. The switching rod pushes the corresponding clamping body due to the displacement of the switching slide in the grip body in order to push this clamping body from its clamped position that brings about the frictionally engaged coupling between the grip body and the corresponding end of the pull cord. The distance between the wedge surfaces on the switching slide in the direction of movement of the switching slide is greater than the distance between the counterwedge surfaces on the two switching rods in the same direction, so that only one of the two wedge surfaces can act at any one time on the corresponding counterwedge surface, in order to ensure that the other clamping body assumes the released position in the coupling position of one clamping body. The preferred design is one in which the wedge surfaces on the switching slide are arranged in a recess each, and this recess has a profile acting as an end position locking means for the two switching positions.

Finally, it is an advantage of the features of the invention explained above that the grip body may also have means to couple the grip body with a spindle shaft for pivoting the slats via pivoting gears in the slat carriages of a vertical blind. This is done, according to another idea of the present invention, by a spindle nut segment, which is movable in the grip body at right angles to the longitudinal axis of a spindle shaft led through the grip body, and which can be coupled with the spindle thread, in order to make possible a pivoting of the slats around their longitudinal axis in one direction or the other due to a movement of the grip body in the upward or downward direction. Another possibility of rotating the spindle shaft may be that the spindle shaft has a small hand wheel for its manual rotation, preferably at its lower end.

The various features of novelty which characterize the invention are pointed out with particularity in the claims annexed to and forming a part of this disclosure. For a better understanding of the invention, its operating advantages and specific objects attained by its uses,. reference is made to the accompanying drawings and descriptive matter in which preferred embodiments of the invention are illustrated.

DETAILED DESCRIPTION OF THE PREFERRED EMBODIMENT

Figure 1:
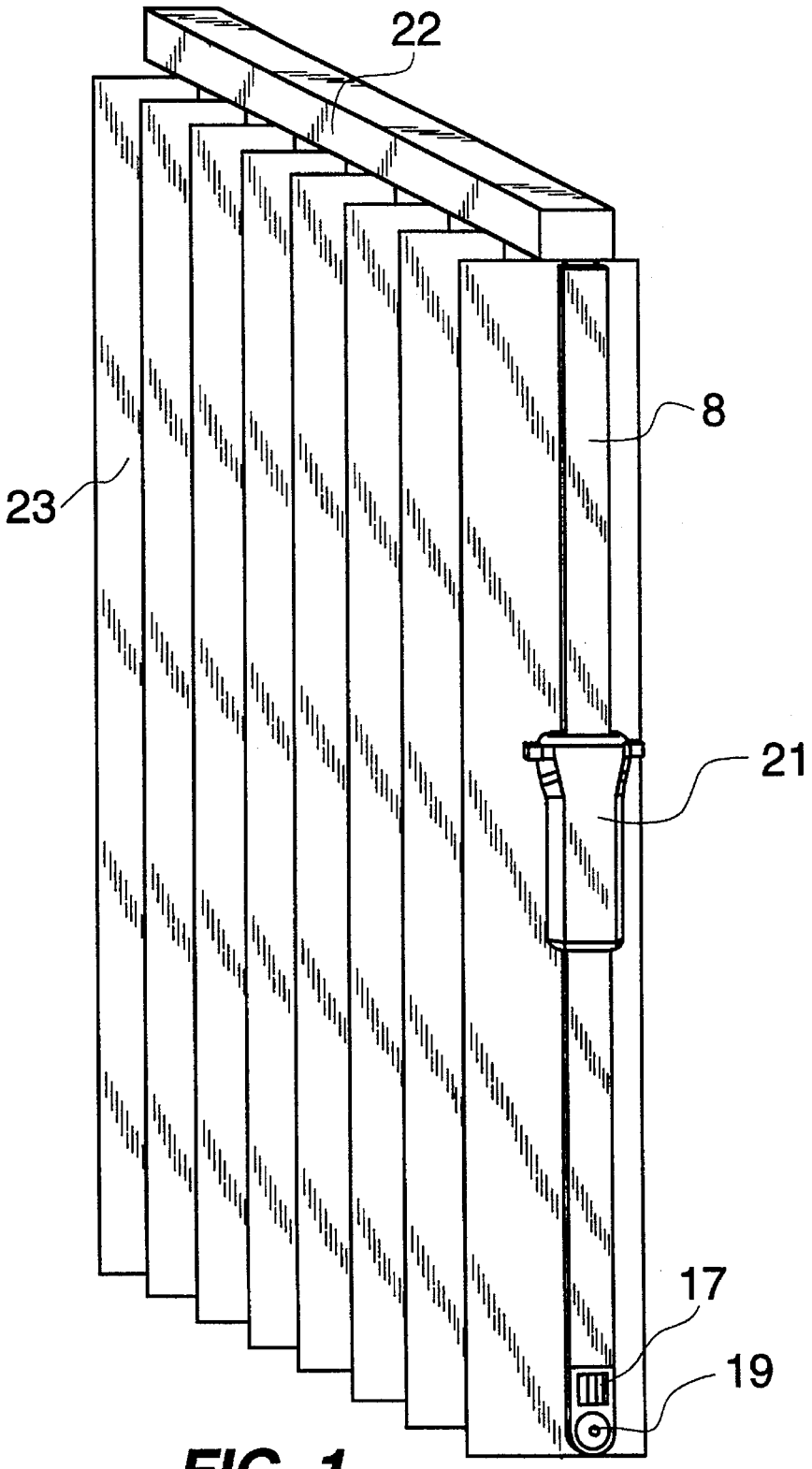
FIG. 1 is a perspective view of a vertical blind.

The vertical blind according to the exemplary embodiment in FIG. 1 has slats 23, which, hanging vertically next to each other, are arranged at spaced locations from one another, and whose top end is arranged, pivotable around the longitudinal axis of the slats 23, in a slat carriage, not recognizable from the drawing, wherein the slat carriages of all slats 23 are laterally displaceable in a support rail 22 that can be fastened horizontally. For this traveling movement, a pull cord, which runs over deflecting means at one end of the support rail 22 and is guided as an endless loop over a deflecting roller 19 at the lower end of a sectional rail 8, is guided through the slat carriage in a support rail 22, so that the pull cord passes through the grip body 21 of an operating device with a leading end 6*a* or leading section and with a return end 6*b* or return section.

Figure 2:
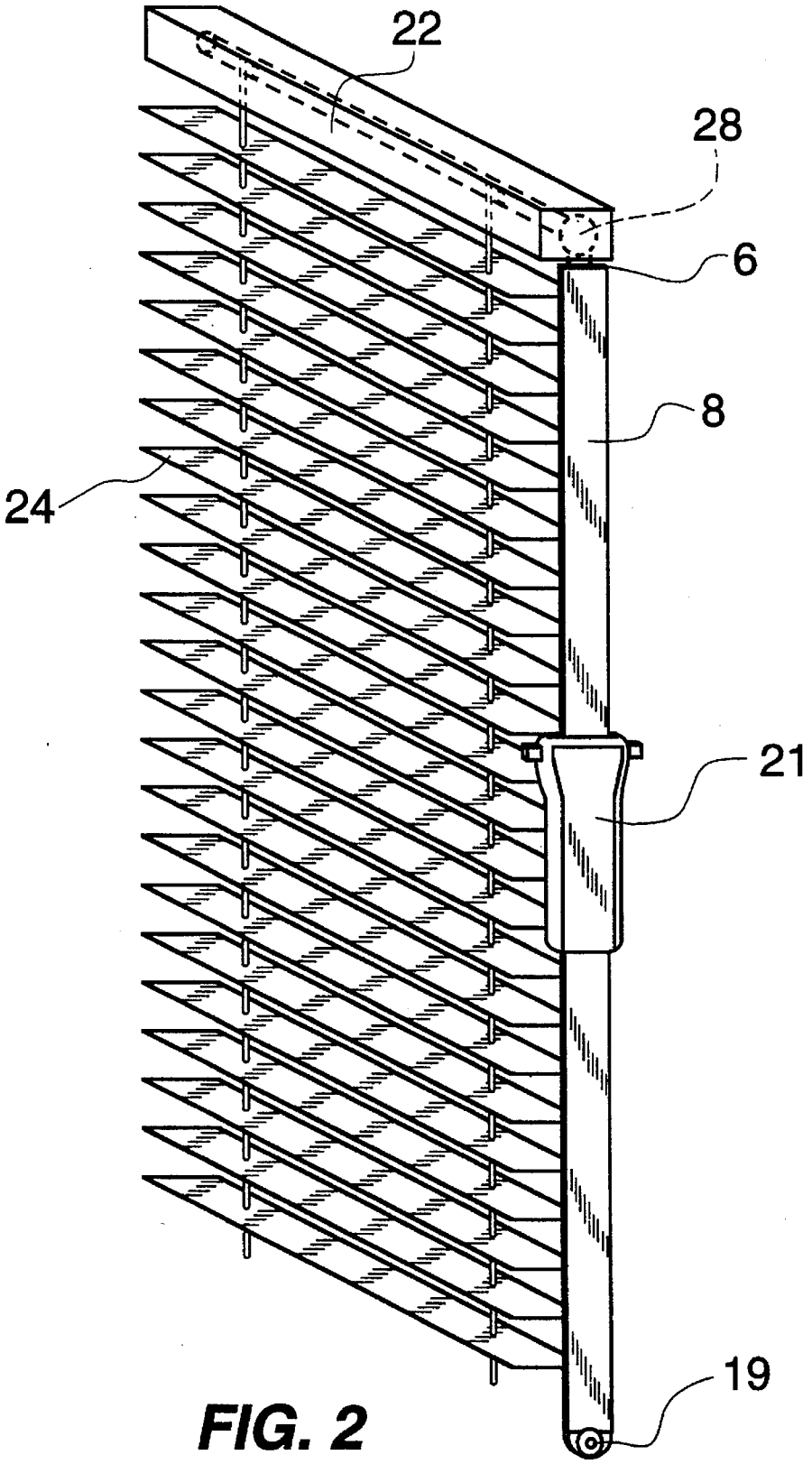
FIG. 2 is a perspective view of a horizontal blind.

The horizontal blind according to the example in FIG. 2 has horizontal slats 24, which are fastened hanging on a pull cord at spaced locations one on top of another. This cord can be wound on a shaft, which is mounted in a horizontally fastened support rail 22, and exits at one end of the support rail 22. A drive wheel 28, via which the pull cord 6 is laid in a vertically extending loop analogously to the example in FIG. 1, is fastened to this end of the shaft, so that it is guided over a deflecting roller 19 at the lower end of a stationarily arranged sectional rail 8, on which a grip body 21 of an operating device can be moved up and down and be optionally coupled with the leading end or the return end of the pull cord 6 due to frictional engagement.

Figure 5:
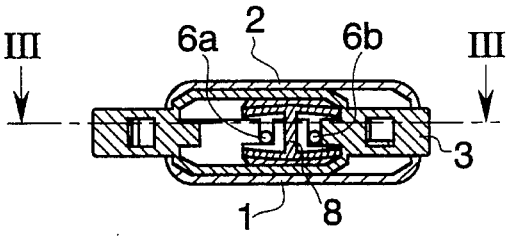
FIG. 5 is a cross sectional view through the grip body along line V—V in FIG. 3.
Figure 3:
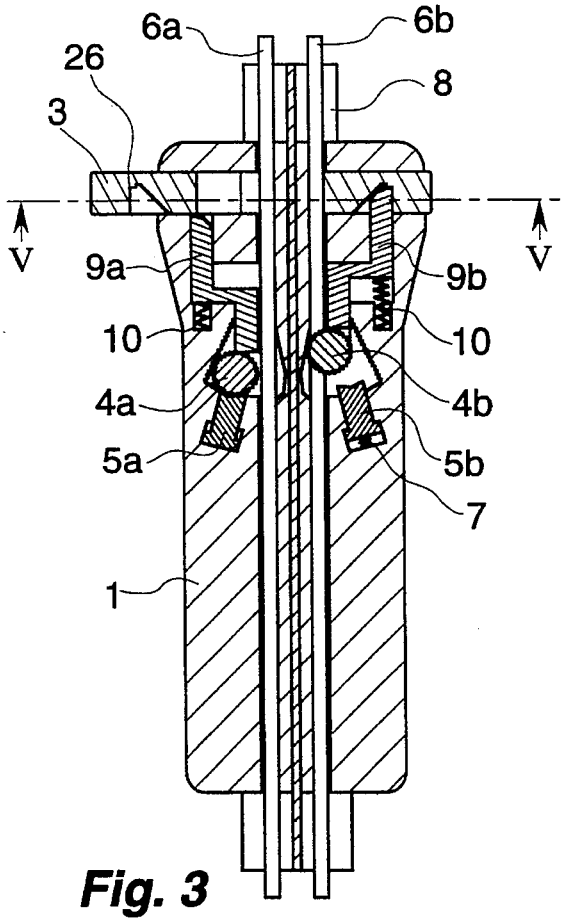
FIG. 3 is a vertical sectional view through the grip body along line III—III in FIG. 5 in a switching position A.
Figure 4:
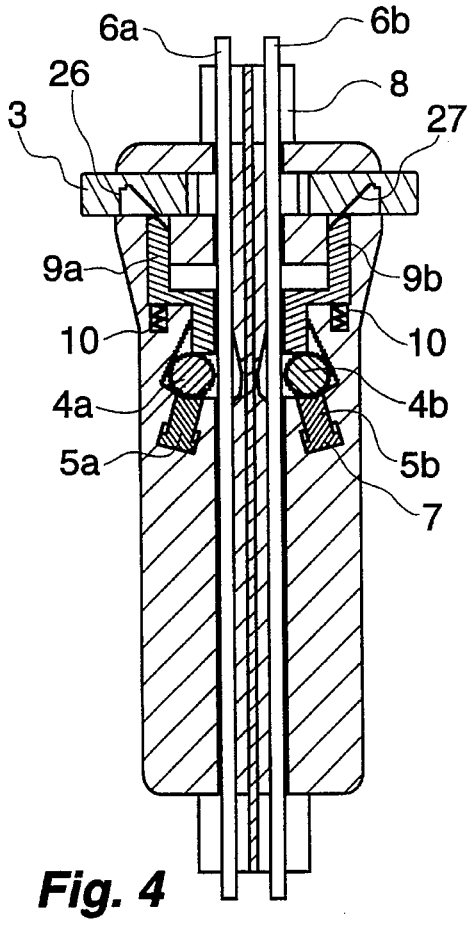
FIG. 4 is a sectional view corresponding to FIG. 3 in a switching position B.

According to the representation in FIGS. 3, 4 and 5, the grip body 21 is comprised of two grip body parts 1 and 2, whose division is located approximately in the vertical central plane. The two grip body parts 1 and 2 surround a vertically extending and stationarily arranged sectional rail 8, which has an H-shaped cross-sectional profile corresponding to FIG. 5. Thus, channels, into which the two pull cord ends 6*a* and 6*b* are placed, are formed on the two open sides of the H. The pull cord running over the deflecting roller 19 at the lower end of the sectional rail 8 is thus arranged hidden in the sectional rail 8, and it does not represent a hazard of strangling for small children.

In the exemplary embodiment according to FIGS. 3, 4 and 5, clamping bodies 4*a* and 4*b* made of clamp rollers placed loosely into the recesses are arranged in recesses of both grip body parts 1 and 2. They have a jacket surface that is corrugated or is made rough in another manner. The limiting walls of each of the two recesses cooperating with this jacket surface converge toward one another in the manner of a wedge, and one of these two limiting walls is arranged in an undercut, which is opposite the respective clamp roller 4*a* and 4*b* in relation to the pull cord 6 passing through the recess. In the case of a displacement of the grip body 21 in relation to the pull cord 6, firm coupling of the grip body 21 with the pull cord 6 can be achieved by frictional engagement by means of one of the two clamp rollers 4*a* or 4*b*. A switching rod 9*a* or 9*b*, which is movably guided in the grip body 21 approximately in parallel to the pull cord 6 and cooperates with wedge surfaces 26 or 27 on a switching slide 3, is associated with each clamping body 4*a* and 4*b*. The end of each switching rod 9*a* or 9*b* facing the switching slide 3 is provided with corresponding counterwedge surfaces. The wedge surfaces 26 and 27 are arranged in recesses of the switching slide 3 with opposite direction of inclination, so that a displacement of the switching rod 9*a* or of the switching rod 9*b* can be alternatively achieved by a displacement of the switching slide 3 in the grip body 21. In the example, a displacement of the switching slide 3 to the right brings about an axial displacement of the switching rod 9*b* in the downward direction, and a displacement of the switching slide 3 to the left brings about an axial displacement of the switching rod 9*a* in the downward direction. This axial displacement of the switching rods 9*a* and 9*b* takes place against the action of a spring 10. In the direction of displacement of the switching slide 3, the recesses with the wedge surfaces 26 and 27 are located at a distance from each other that is greater than the distance between the counterwedge surfaces on the switching rods 9*a* and 9*b*. It is achieved as a result that the switching rods can be operated only alternatively, so that a clamping connection is also possible only with one of the two pull cord ends 6*a* or 6*b*. The recesses with the wedge surfaces 26 and 27 of the switching slide 3 preferably have a profile, which also acts as an end position locking means for the two switching positions. To achieve an initial friction between the circumference of the clamp rollers 4*a* or 4*b* and the corresponding pull cord end 6*a* or 6*b*, spring-loaded pressing pieces 5*a* and 5*b* are arranged under the clamp rollers 4*a* and 4*b*, preferably in the direction toward the clamp rollers, and these pressing pieces 5*a* and 5*b* move the corresponding clamp roller 4*a* or 4*b* when the switching rod 9*a* or 9*b* is axially displaced by one of the springs 10 into a recess of the switching slide 3, in order to bring about a clamping coupling of the grip body 21 with the corresponding pull cord end.

Figure 8:
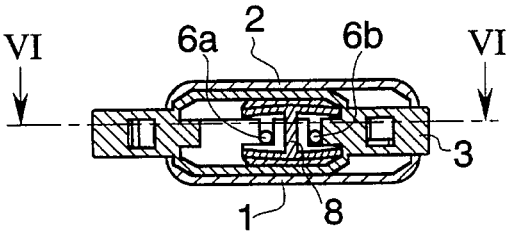
FIG. 8 is a sectional view along line VIII—VIII in FIG. 6.
Figure 6:
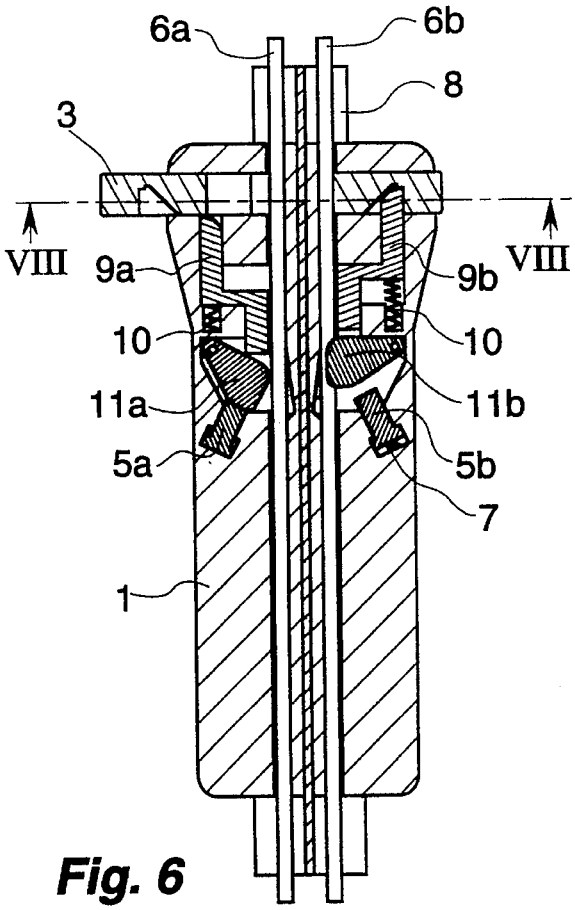
FIG. 6 is a sectional view corresponding to FIG. 3, but with a modified clamping body.
Figure 7:
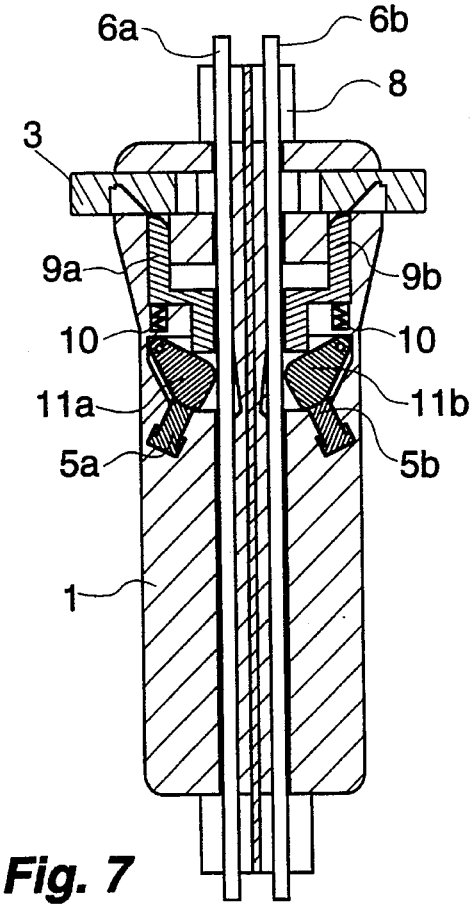
FIG. 7 is a sectional view corresponding to FIG. 4, but with the modified clamping body.

The exemplary embodiment shown in FIGS. 6 through 8 corresponds to the description given for FIGS. 3 through 5, with the exception that the above-described clamp rollers 4*a*, 4*b* are replaced with respective clamping bodies 11*a* and 11*b*, which are arranged, pivotable around an axis extending at right angles to the pull cord, in the recess of the grip body 21. Further details become apparent from the graphic representation in FIGS. 6 and 7.

In the two exemplary embodiments according to FIGS. 3 through 5 as well as 6 through 8, a frictionally engaged coupling of the grip body 21 with one of the two pull cord ends 6*a* or 6*b* can be achieved by a horizontal movement of the switching slide 3 via the clamping means. The respective other pull cord end is released from its clamping coupling with the grip body 21 by an axial displacement of the switching rod 9*a* or 9*b*.

Figure 9:
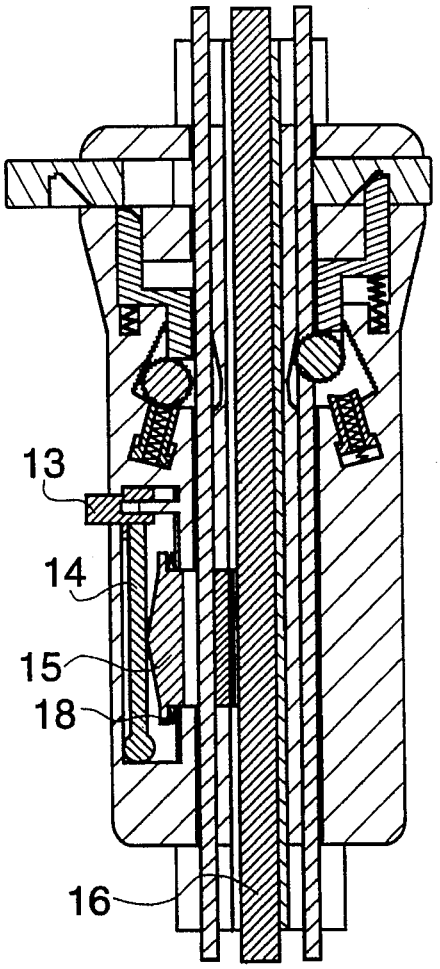
FIG. 9 is a vertical sectional view through a grip body with a drive means for a spindle shaft in a switching position D.
Figure 10:
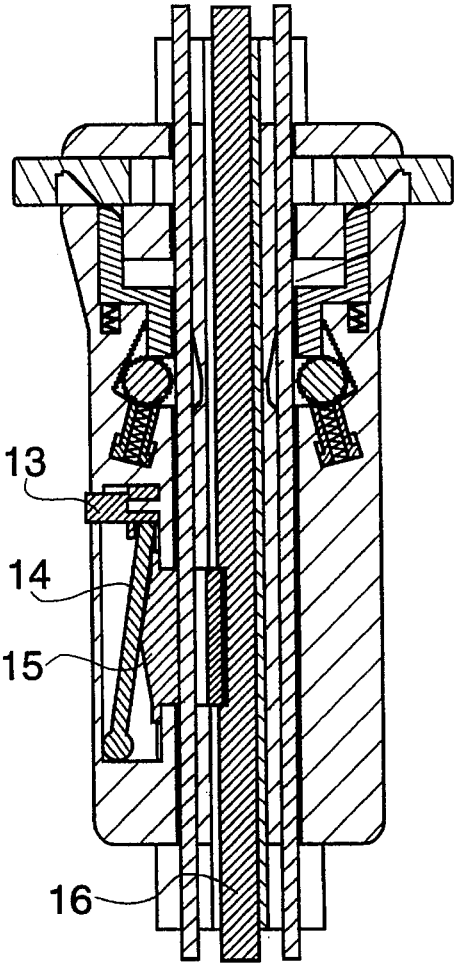
FIG. 10 is a sectional view corresponding to FIG. 9 in a switching position E.

In the exemplary embodiment according to FIGS. 9 and 10, the clamping means for the frictionally engaged coupling of the grip body 21 with the pull cord ends 6*a* and 6*b* are designed corresponding to the description given for the examples shown in FIGS. 3 through 5 or possibly also the description for FIGS. 6 through 8. In addition, a spindle shaft 16 passes through a channel of the grip body 21. A spindle nut segment 15, whose threads can be pressed against the spindle thread by overcoming the force of a spring and can be engaged with same, is movably arranged in the grip body 21 radially to the longitudinal axis of the spindle shaft 16. A spring 18 is supported by the grip body 21, on the one hand, and by a collar edge of the spindle nut segment 15, on the other hand. A switching lever 14, which is mounted pivotably in the grip body 21, can be pivoted by the force of a finger via a pushbutton 13 projecting outwards, so that the threads of the spindle nut segment 15 and of the spindle shaft 16 become engaged, and the spindle shaft can be rotated in one direction or the other by a movement of the grip body 21 in the upward or downward direction, in order to pivot, e.g., the slats of a vertical blind in one direction or the other. FIG. 10 shows the engaged position of the threads of the spindle nut segment 15 and of the spindle shaft 16. FIG. 9 shows the resting position stabilized by the spring 28. Instead of the operating device for a spindle shaft 16 passing through the grip body 21, which was explained in connection with FIGS. 9 and 10, only a small hand wheel 17, whose knurls are arranged laterally from openings of a sectional cover cap 20 at the lower end of the sectional rail 8, is arranged for its operation according to the example in FIG. 11. The deflecting roller 19 for the pull cord 6 is arranged under this small hand wheel 17. The example in FIG. 10 clearly shows that the pull cord 6 and the sectional rail 8 do not have to be led up to the lower end of the blind in each case, but they may end at any height if it is accepted that the movement of the pull cord may take place in sections, possibly by grasping it again, using the mechanism accommodated in the grip body 21.

Figure 11:
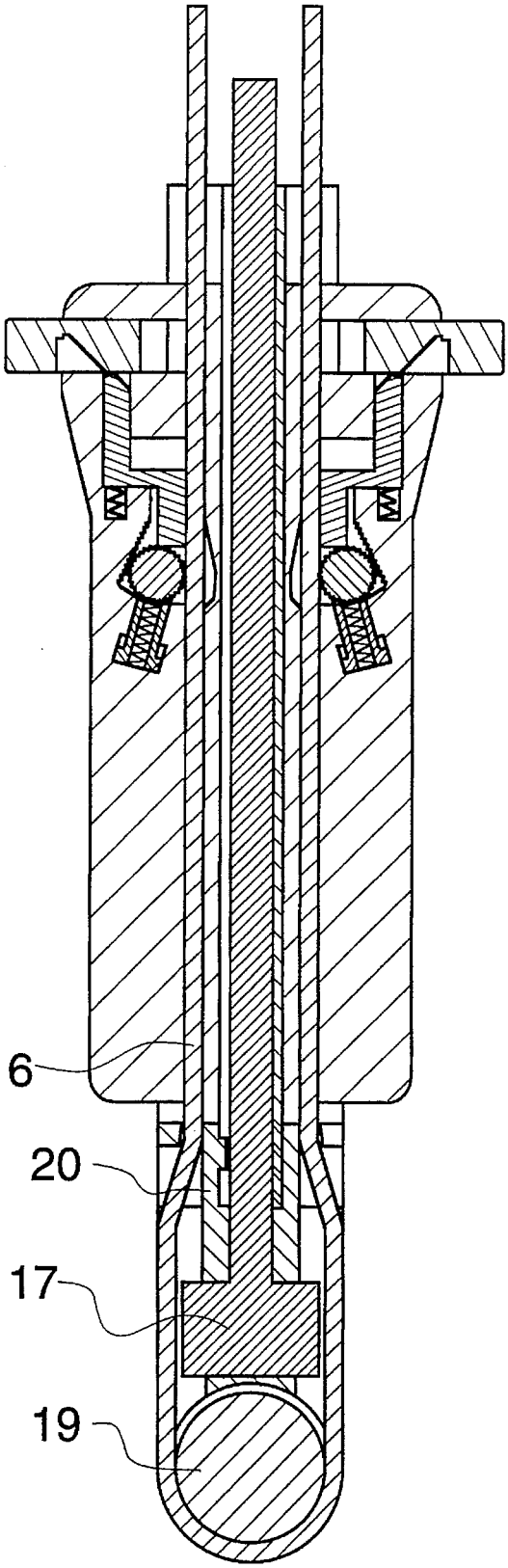
FIG. 11 is a vertical sectional view through a grip body with a drive for the spindle shaft, which drive is modified compared with FIGS. 9 and 10.

The example according to FIG. 11 also shows that the spring 7 loading the clamp rollers 4*a* and 4*b* is accommodated in a blind hole of the respective pressing piece 5*a* and 5*b*.

While specific embodiments of the invention have been shown and described in detail to illustrate the application of the principles of the invention, it will be understood that the invention may be embodied otherwise without departing from such principles.

APPENDIX

LIST OF REFERENCE NUMBERS:

1 Grip body part
2 Grip body part
3 Switching slide
4 Clamping body
4*a* Clamp roller
4*b* Clamp roller
5*a* Pressing piece
5*b* Pressing piece
6 Pull cord
6*a* Leading end
6*b* Return end
7 Pressing piece spring
8 Sectional rail
9*a* Switching rod
9*b* Switching rod
10 Switching rod spring
11*a* Clamping body
11*b* Clamping body
13 Pushbutton
14 Switching lever
15 Spindle nut segment
16 Spindle shaft
17 Spindle shaft hand wheel
18 Spring
19 Deflecting roller
20 Sectional cover cap
21 Grip body
22 Support rail
23 Vertical slat
24 Horizontal slat
25 Wedge surface
26 Wedge surface
27 Drive wheel

What is claimed is:

1. A device for the operation of a blind, comprising:

a pull cord provided in the form of a loop and including a leading end portion and a return end portion;

a grip body that can be grasped by a user of the blind, the grip body defining a leading end passage accommodating said leading end of said pull cord and defining a return end passage accommodating said return end portion of said pull cord, said grip body including leading end clamping means for clamping said leading end portion of said pull cord, said leading end clamping means being switchable from an outside of said grip body, and said grip body including return end clamping means for clamping said return end portion of said pull cord, said return end clamping means being switchable from an outside of said grip body;

a section rail, said grip body being arranged movably along, and guided by, said section rail, said section rail accommodating said pull cord leading end portion and accommodating said pull cord return end portion, said section rail defining channels extending in a longitudinal direction and including a leading end portion channel and a return end portion channel.

2. A device according to claim 1, further comprising a deflecting roller disposed at a lower end of said section rail, said deflecting roller for guiding said-pull cord in the form of an endless cord.

3. A device according to claim 1, wherein said sectional rail is provided with a longitudinal axis arranged vertically aligned in parallel to said leading end portion and said return end portion of said pull cord.

4. A device according to claim 1, wherein said leading end clamping means and said return end clamping means comprised a clamp roller, arranged freely movable in a recess of said grip body, said clamp roller having a roughened jacket surface, said recess having limiting walls converging toward each other in a direction of clamping, said limiting walls cooperating with said jacket surface of said clamp roller within said recess.

5. A device according to claim 4, wherein said limiting walls converge in a wedge-shaped manner, one of said two limiting walls being arranged in an area of an undercut on a side of said pull cord, extending through said recess, which is opposite said clamp roller.

6. A device according to claim 4, further comprising a pressing piece acting against said clamp roller, a spring biasing said pressing piece in a direction of clamping, said pressing piece being movably guided in said grip body.

7. A device according to claim 4, wherein said clamping means further includes a switching slide, guided in said grip body at right angles to said pull cord, said switching slide being freely exposed with ends on opposite sides of said grip body, switching rods being provided acted on by said switching slide, said switching rods being associated with said leading end clamping means and said return end clamping means respectfully, said switching rods being guided movably in said grip body in parallel to said pull cord for displacement in a releasing direction of said clamping means against a corresponding clamp roller, a spring force biasing said switching rods against displacement in said releasing direction.

8. A device according to claim 7, wherein said two switching rods are tensioned in a direction against said switching slide by associated said springs, said springs being supported in said grip body acting against said two switching rods.

9. A device according to claim 4, wherein said clamping means are mounted pivotably around an axis of said gripping body.

10. A device according to claim 8, wherein: said switching slide includes wedge surfaces for acting on wedge surfaces of said switching rods, a distance between said wedge surfaces of said switching slide in a direction of movement of said switching slide is greater than a distance between a said wedge surfaces of said switching rods in the same direction, whereby only one of said wedge surfaces of said switching slide can act on a corresponding wedge surface of one of said switching rods at any one time.

11. A device according to claim 8, wherein said wedge surfaces of said switching slide act on said counterwedge surfaces on said switching rods, each of said switching rods being arranged in a recess in said gripping means, said recess defining an end position locking means for two switch positions.

12. A device according to claim 6, wherein said spring tensioning said pressing pieces is arranged in a pretensioned state in a blind hole of said pressing piece.

13. A device according to claim 1, further comprising:

a spindle shaft;

a plurality of slats;

a slat carriage and pivoting gears, said spindle shaft being connected to said pivoting gears for pivoting said slats in said slat carriage, said spindle shaft being guided freely rotatably through a channel of said gripping body.

14. A device according to claim 13, further comprising a spindle nut segment arranged in said grip body radially movable against said spindle shaft and pressed with said shaft against said spindle shaft by means of an outer handle for overcoming a force of a spring.

15. A device according to claim 13, wherein said spindle shaft includes an adjusting wheel at a lower end, said pull cord being led around said adjusting wheel.

16. A device in accordance with claim 15, further comprising:

a deflecting roller positioned at a lower end of said section rail, said deflecting roller for guiding said pull cord in the form of an endless cord, said pull cord being lead around said adjusting wheel over said deflecting roller.

17. A device for the operation of a blind, comprising:

a pull cord provided in the form of a loop and including a leading end portion and a return end portion;

a section rail accommodating said pull cord leading end portion and accommodating said pull cord return end portion, said section rail defining channels extending in a longitudinal direction and including a leading end portion channel and a return end portion channel, said section rail having a cross section with an H-shaped profile with convex lateral surfaces a grip body that can be grasped by a user of the blind, the grip body defining a leading end passage accommodating said leading end of said pull cord and defining a return end passage accommodating said return end portion of said pull cord, said grip body including leading end clamping means for damping said leading end portion of said pull cord, said leading end clamping means being switchable from an outside of said grip body, said grip body including return end clamping means for clamping said return end portion of said pull cord, said return end clamping means being switchable from an outside of said grip body, said grip body being arranged movably along, and guided by said section rail.

18. A device for the operation of a blind, comprising:

a pull cord including a leading end portion and a return end portion;

a section raft accommodating said pull cord, said pull cord being movably positioned in, and guided by, said section rail, said section rail hiding said pull cord in said section rail;

grip means on said section rail for providing access to said pull cord with respect to said section rail.

19. A device according to claim 18, wherein:

said section rail wraps around said pull cord to block access to said pull cord by a hand of an operator and defines a groove for access to said pull cord by said grip means, said section rail extends for substantially a longitudinal length of said pull cord from a support rail, said section rail also being supported by hanging from said support rail.

20. A device according to claim 18, wherein:

said section rail defines channels extending in a longitudinal direction and includes a leading end portion channel and a return end portion channel, said section rail having a cross section with an H-shaped profile with convex lateral surfaces.

* * * * *